US009435089B1

(12) United States Patent
Diaz

(10) Patent No.: US 9,435,089 B1
(45) Date of Patent: Sep. 6, 2016

(54) SPEARING SYSTEM

(71) Applicant: Diana Diaz, New York, NY (US)

(72) Inventor: Diana Diaz, New York, NY (US)

( * ) Notice: Subject to any disclaimer, the term of this patent is extended or adjusted under 35 U.S.C. 154(b) by 0 days.

(21) Appl. No.: 14/821,892

(22) Filed: Aug. 10, 2015

(51) Int. Cl.
*F41B 13/10* (2006.01)
*E01H 1/12* (2006.01)

(52) U.S. Cl.
CPC ..... *E01H 1/12* (2013.01)

(58) Field of Classification Search
CPC ..... E01H 1/12; E01H 2001/1233; E01H 2001/1293; B25J 15/0071; A47G 21/023; A01K 97/14; A47J 43/18
USPC ..... 294/182, 61, 19.3
See application file for complete search history.

(56) References Cited

U.S. PATENT DOCUMENTS 50,859 A * 11/1865 Tyler ..... E01H 1/12 294/61
273,560 A * 3/1883 Lowe ..... A01D 45/006 111/908
1,053,418 A * 2/1913 Martin ..... E01H 1/12 294/50.5
1,246,487 A * 11/1917 Summers ..... A01D 46/087 294/61
1,598,422 A * 8/1926 Carter ..... A47G 21/023 30/129
1,801,084 A * 4/1931 Huie ..... A47G 21/023 294/61
1,993,314 A * 3/1935 Belford ..... A01D 11/00 294/61
2,167,411 A * 7/1939 Andros ..... A47G 21/023 30/129
2,420,710 A * 5/1947 Livingston ..... A47G 21/023 30/129
2,500,647 A * 3/1950 Schulthess ..... E01H 1/12 294/50
2,552,467 A * 5/1951 Thomas ..... E01H 1/12 294/61
2,695,188 A 11/1954 Klausman et al.
2,800,354 A * 7/1957 King ..... E01H 1/12 294/50.5
2,862,755 A * 12/1958 Gulden ..... A01B 1/16 294/50
2,974,993 A * 3/1961 Duniven ..... A47G 21/023 294/61
3,221,485 A * 12/1965 Jenkins ..... A01B 1/20 172/374
4,183,570 A 1/1980 Broyles et al.
4,502,722 A 3/1985 Rocquin
4,856,835 A 8/1989 Pacione
5,261,496 A * 11/1993 Smotherman ..... A01B 1/16 172/25
5,370,433 A 12/1994 Yost
D376,524 S 12/1996 Miller et al.
5,642,911 A 7/1997 Gatch
6,050,626 A 4/2000 Dudley
8,002,319 B1 * 8/2011 Hahn ..... E01H 1/1206 294/1.4
2009/0126331 A1 * 5/2009 Williams ..... E01H 1/12 56/400.04

FOREIGN PATENT DOCUMENTS

GB 191120362 A * 0/1911 ..... A47G 21/023
GB 528153 A * 10/1940 ..... A47G 21/023
GB 851758 A * 10/1960 ..... A01G 1/12
GB 2231248 A * 11/1990 ..... A01D 51/00
WO WO2004062857 7/2004

* cited by examiner

*Primary Examiner* — Gabriela Puig

(57) ABSTRACT

A spearing system includes a pitch fork that has a handle and a plurality of tines. The handle may be manipulated. Each of the tines may puncture an object. Thus, the object may be retrieved from a support surface without requiring a user to bend over. A release is slidably coupled to the pitch fork and the release may be manipulated. The release is positioned adjacent to the tines. The release is positionable in a retracted position such that the release allows the tines to puncture the object. The release is positionable in a deployed position such that the release may release the object from the tines.

10 Claims, 3 Drawing Sheets

SPEARING SYSTEM

BACKGROUND OF THE DISCLOSURE

Field of the Disclosure

The disclosure relates to spearing devices and more particularly pertains to a new spearing device for removing an object from a support surface without bending over.

SUMMARY OF THE DISCLOSURE

An embodiment of the disclosure meets the needs presented above by generally comprising a pitch fork that has a handle and a plurality of tines. The handle may be manipulated. Each of the tines may puncture an object. Thus, the object may be retrieved from a support surface without requiring a user to bend over. A release is slidably coupled to the pitch fork and the release may be manipulated. The release is positioned adjacent to the tines. The release is positionable in a retracted position such that the release allows the tines to puncture the object. The release is positionable in a deployed position such that the release may release the object from the tines.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
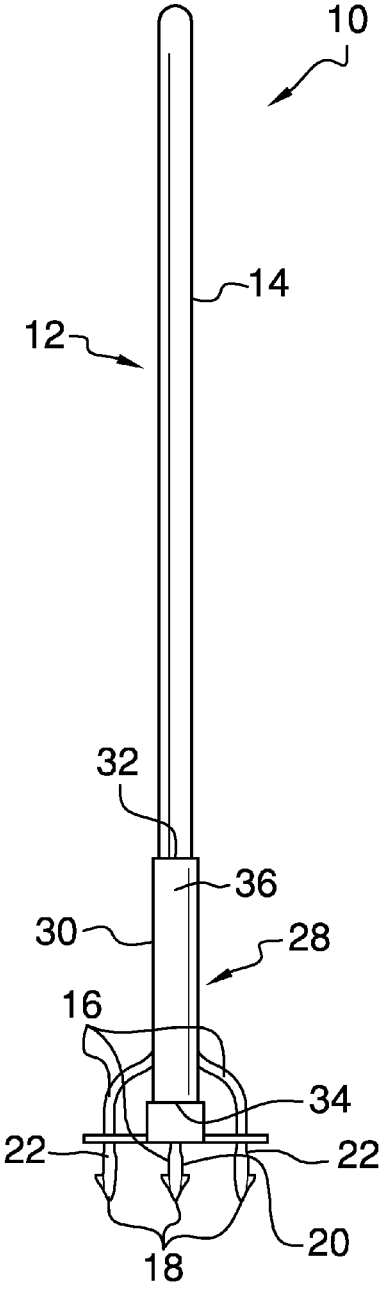
FIG. 1 is a front view of a spearing system according to an embodiment of the disclosure.
Figure 2:
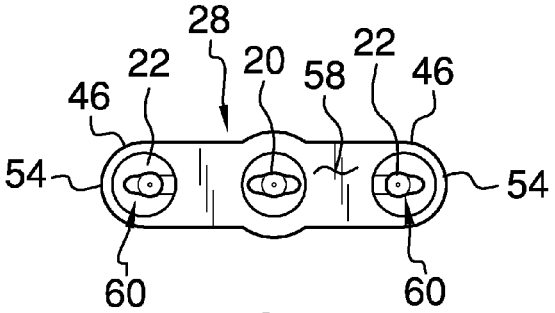
FIG. 2 is a bottom view of an embodiment of the disclosure.
Figure 3:
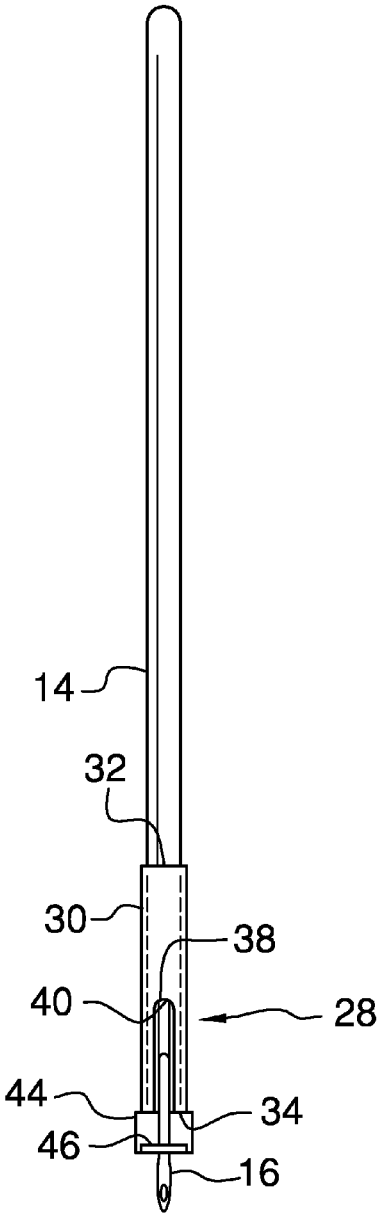
FIG. 3 is a left side phantom view of an embodiment of the disclosure.
Figure 4:
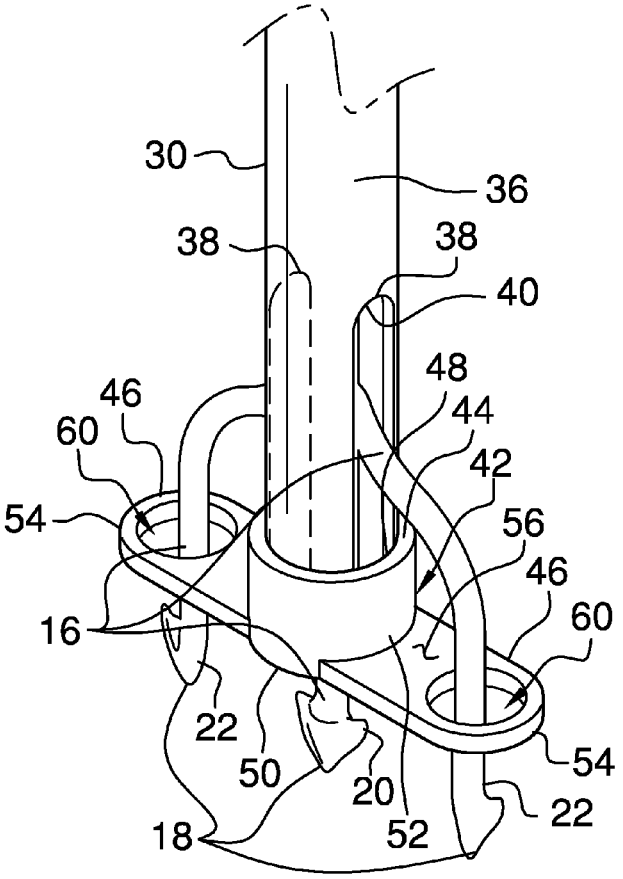
FIG. 4 is a perspective view of an embodiment of the disclosure.
Figure 5:
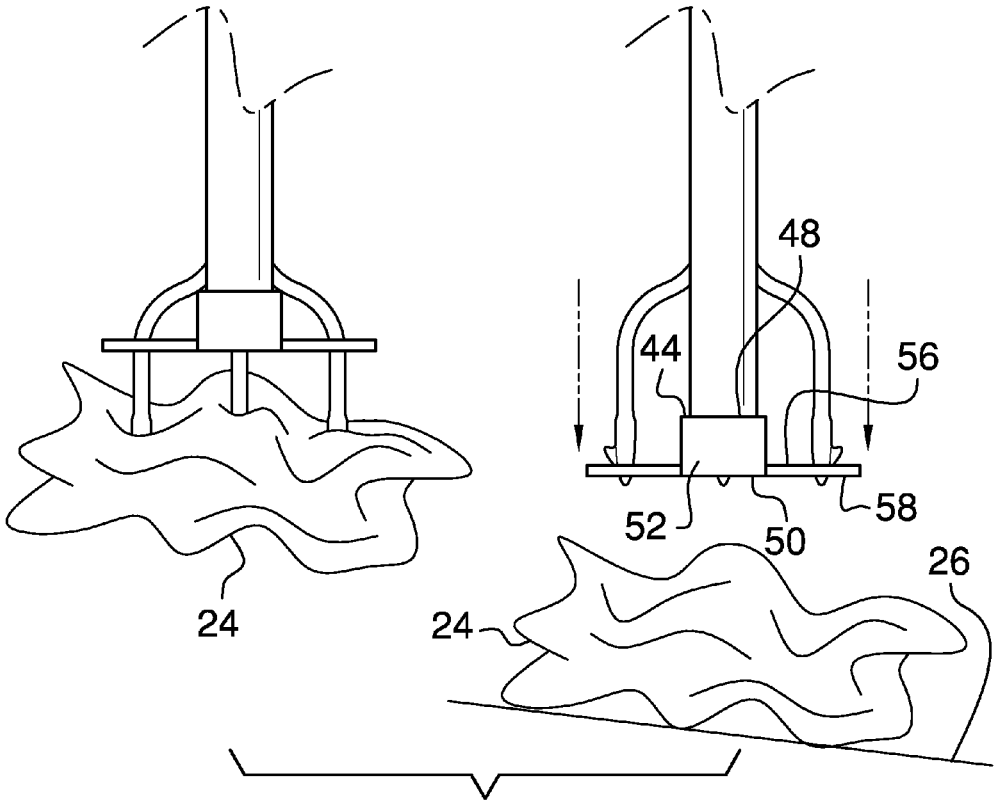
FIG. 5 is a perspective in-use view of an embodiment of the disclosure.

With reference now to the drawings, and in particular to FIGS. 1 through 5 thereof, a new spearing device embodying the principles and concepts of an embodiment of the disclosure and generally designated by the reference numeral 10 will be described.

As best illustrated in FIGS. 1 through 5, the spearing system 10 generally comprises a pitch fork 12 that has a handle 14 and a plurality of tines 16. Each of the tines 16 is coupled to and extends away from the handle 14. Each of the tines 16 has a distal end 18 with respect to the handle 14 and the tines 16 include a central tine 20 and a pair of lateral tines 22. Each of the lateral tines 22 is spaced apart from the central tine 20. The handle 14 may be manipulated thereby facilitating the distal end 18 of each of the tines 16 to puncture an object 24. Thus, the object 24 may be retrieved from a support surface 26 without requiring a user to bend over. The support surface 26 may be ground and the object 24 may comprise paper, leaves, cigarette butts or other object considered to be trash.

A release 28 is slidably coupled to the pitch fork 12 such that the release 28 may be manipulated. The release 28 is positioned adjacent to the tines 16. The release 28 is positionable in a retracted position such that the release 28 allows the tines 16 to puncture the object 24. The release 28 is positionable in a deployed position such that the release 28 may release the object 24 from the tines 16.

The release 28 comprises a tube 30 that has a first end 32, a second end 34 and an outer wall 36 extending between the first end 32 and the second end 34. Each of the first end 32 and the second end 34 is open and the tube 30 is substantially hollow. The outer wall 36 has a pair of slots 38 extending therethrough and each of the slots 38 extends from the second end 34 toward the first end 32. The slots 38 are positioned on opposite side of the tube 30 such that the slots 38 are aligned with each other and each of the slots 38 has a terminal surface 40. The first end 32 of the release 28 insertably receives the handle 14 such that the central tine 20 extends outwardly through the second end 34 and each of the lateral tines 22 extends outwardly through an associated one of the slots 38.

A stop 42 is provided and the stop 42 is coupled to the tube 30. The stop 42 has a receiver 44 and a pair of tabs 46. The receiver 44 has a primary end 48, a secondary end 50 and an exterior wall 52 extending between the primary end 48 and the secondary end 50. Each of the primary end 48 and the secondary end 50 is open and the receiver 44 is substantially hollow. The exterior wall 52 is continuous such that the receiver 44 has a cylindrical shape. The primary end 48 insertably receives the tube 30 having the second end 34 of the tube 30 being aligned with the secondary end 50 of the receiver 44.

Each of the tabs 46 is coupled to and extends away from the exterior wall 52 of the receiver 44. Each of the tabs 46 is positioned adjacent to the secondary end 50 of the receiver 44. The tabs 46 are positioned on opposite sides of the receiver 44 such that the tabs 46 are aligned with an associated one of the slots 38 in the tube 30. Each of the tabs 46 has a distal end 54 with respect to the tube 30 and each of the tabs 46 has a top surface 56 and a bottom surface 58. Each of the tabs 46 has an opening 60 extending through the top surface 56 and the bottom surface 58. The opening 60 on each of the tabs 46 is positioned proximate the distal end 54 of an associated one of the tabs 46. Each of the lateral tines 22 extends through the opening 60 of an associated one of the tabs 46.

The bottom surface 58 of each of the tabs 46 is spaced from the distal end 18 of each of the tines 16 when the release 28 is positioned in the retracted position. The primary end 48 of the receiver 44 abuts each of the lateral tines 22 when the release 28 is positioned in the retracted position. Thus, the release 28 is inhibited from being slid upwardly off of the handle 14. The bottom surface 58 engages the object 24 when the release 28 is positioned in the deployed position thereby facilitating the object 24 to be urged from the distal end 18 of the tines 16. The terminal surface 40 of each of the slots 38 abuts an associated one of the lateral tines 22 when the release 28 is positioned in the deployed position. Thus, the release 28 is inhibited from being slid downwardly off of the handle 14.

In use, the handle 14 is gripped and the release 28 is positioned in the retracted position. The handle 14 is manipulated such that the tines 16 puncture the object 24 on the support surface 26. The handle 14 is manipulated to lift the object 24 from the support surface 26. The release 28 is positioned in the deployed position and the object 24 is urged off of the tines 16. The object 24 may be deposited in a receptacle or the like thereby facilitating the object 24 to be disposed of. The release 28 is positioned in the retracted position and the handle 14 is manipulated to continue removing additional objects 24 on the support surface 26.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A spearing system comprising:

a pitch fork having a handle and a plurality of tines, said handle being configured to be manipulated, each of said tines being configured to puncture an object thereby facilitating the object to be retrieved from a support surface without requiring a user to bend over; and a release being slidably coupled to said pitch fork wherein said release is configured to be manipulated, said release being positioned adjacent to said tines, said release being positionable in a retracted position wherein said release is configured to allow said tines to puncture the object, said release being positionable in a deployed position wherein said release is configured to release the object from said tines, wherein said release comprises a tube having a first end, a second end and an outer wall extending between said first end and said second end, each of said first end and said second end being open, said tube being substantially hollow, wherein said outer wall has a pair of slots extending therethrough, each of said slots extending from said second end toward said first end, said slots being positioned on opposite side of said tube such that said slots are aligned with each other, each of said slots having a terminal surface.

2. The system according to claim 1, wherein each of said tines is coupled to and extending away from said handle, each of said tines having a distal end with respect to said handle, said tines including a central tine and a pair of lateral tines, each of said lateral tines being spaced apart from said central tine.

3. The system according to claim 1, wherein:

said plurality of tines includes a central tine and a pair of lateral tines; and said first end insertably receiving said handle such that said central tine extends outwardly through said second end and each of said lateral tines extends outwardly through an associated one of said slots.

4. The system according to claim 1, wherein said release further comprises a stop being coupled to said tube, said stop having a receiver and a pair of tabs.

5. The system according to claim 4, wherein said receiver has a primary end, a secondary end and an exterior wall extending between said primary end and said secondary end, each of said primary end and said secondary end being open, said receiver being substantially hollow, said exterior wall being continuous such that said receiver has a cylindrical shape, said primary end insertably receiving said tube having said second end of said tube being aligned with said secondary end of said receiver.

6. The system according to claim 5, wherein:

said release includes the tube, said tube having a pair of slots; and each of said tabs is coupled to and extends away from said exterior wall of said receiver, each of said tabs being positioned adjacent to said secondary end, said tabs being positioned on opposite sides of said receiver such that said tabs are aligned with an associated one of said slots in said tube, each of said tabs having a distal end with respect to said tube.

7. The system according to claim 6, wherein:

said plurality of tines includes a pair of lateral tines; and each of said tabs has a top surface and a bottom surface, each of said tabs having an opening extending through said top surface and said bottom surface, said opening on each of said tabs being positioned proximate said distal end of an associated one of said tabs such that each of said lateral tines extends through said opening of an associated one of said tabs.

8. The system according to claim 7, wherein:

each of said tines has a distal end, said plurality of tines including the pair of lateral tines; and said bottom surface of each of said tabs being spaced from said distal end of each of said tines when said release is positioned in said retracted position, said primary end of said receiver abutting each of said lateral tines when said release is positioned in said retracted position such that said release is inhibited from being slid upwardly off of said handle.

9. The system according to claim 7, wherein said bottom surface is configured to engage the object when said release is positioned in said deployed position thereby facilitating the object to be urged from said distal end of said tines, said terminal surface of each of said slots abutting an associated one of said lateral tines when said release is positioned in said deployed position such that said release is inhibited from being slid downwardly off of said handle.

10. A spearing system comprising:

a pitch fork having a handle and a plurality of tines, each of said tines being coupled to and extending away from said handle, each of said tines having a distal end with respect to said handle, said tines including a central tine and a pair of lateral tines, each of said lateral tines being spaced apart from said central tine, said handle being configured to be manipulated, said distal end of each of said tines being configured to puncture an object thereby facilitating the object to be retrieved from a support surface without requiring a user to bend over; and a release being slidably coupled to said pitch fork wherein said release is configured to be manipulated, said release being positioned adjacent to said tines, said release being positionable in a retracted position wherein said release is configured to allow said tines to puncture the object, said release being positionable in a deployed position wherein said release is configured to release the object from said tines, said release comprising:

a tube having a first end, a second end and an outer wall extending between said first end and said second end, each of said first end and said second end being open, said tube being substantially hollow, said outer wall having a pair of slots extending therethrough, each of said slots extending from said second end toward said first end, said slots being positioned on opposite side of said tube such that said slots are aligned with each other, each of said slots having a terminal surface, said first end insertably receiving said handle such that said central tine extends outwardly through said second end and each of said lateral tines extends outwardly through an associated one of said slots, and a stop being coupled to said tube, said stop having a receiver and a pair of tabs, said receiver having a primary end, a secondary end and an exterior wall extending between said primary end and said secondary end, each of said primary end and said secondary end being open, said receiver being substantially hollow, said exterior wall being continuous such that said receiver has a cylindrical shape, said primary end insertably receiving said tube having said second end of said tube being aligned with said secondary end of said receiver, each of said tabs being coupled to and extending away from said exterior wall of said receiver, each of said tabs being positioned adjacent to said secondary end, said tabs being positioned on opposite sides of said receiver such that said tabs are aligned with an associated one of said slots in said tube, each of said tabs having a distal end with respect to said tube, each of said tabs having a top surface and a bottom surface, each of said tabs having an opening extending through said top surface and said bottom surface, said opening on each of said tabs being positioned proximate said distal end of an associated one of said tabs such that each of said lateral tines extends through said opening of an associated one of said tabs, said bottom surface of each of said tabs being spaced from said distal end of each of said tines when said release is positioned in said retracted position, said primary end of said receiver abutting each of said lateral tines when said release is positioned in said retracted position such that said release is inhibited from being slid upwardly off of said handle, said bottom surface being configured to engage the object when said release is positioned in said deployed position thereby facilitating the object to be urged from said distal end of said tines, said terminal surface of each of said slots abutting an associated one of said lateral tines when said release is positioned in said deployed position such that said release is inhibited from being slid downwardly off of said handle.

* * * * *